US006479780B2

(12) United States Patent
Virtanen et al.

(10) Patent No.: US 6,479,780 B2
(45) **Date of Patent: *Nov. 12, 2002**

(54) CIRCUIT BREAKER FOR DISCONNECTING AN ELECTRICAL APPARATUS FROM ELECTRICAL NETWORK

(75) Inventors: Esa Virtanen, Vaasa (FI); Tapani Tiitola, Vaasa (FI); Vesa Virtanen, Vaasa (FI)

(73) Assignee: ABB Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,649

(22) PCT Filed: Feb. 4, 1998

(86) PCT No.: PCT/FI98/00103

§ 371 (c)(1),
(2), (4) Date: Mar. 17, 2000

(87) PCT Pub. No.: WO98/35419

PCT Pub. Date: Aug. 13, 1998

(65) Prior Publication Data

US 2002/0053554 A1 May 9, 2002

(30) Foreign Application Priority Data

Feb. 6, 1997 (FI) ..... 970504

(51) Int. Cl.[7] ..... H01H 33/02

(52) U.S. Cl. ..... 218/154; 200/400

(58) Field of Search ..... 218/7, 14, 155, 218/156, 157, 78, 84, 154; 200/400–401

(56) References Cited

U.S. PATENT DOCUMENTS

| | | | | |
|---|---|---|---|---|
| 2,330,690 A | | 9/1943 | Dannenberg | |
| 2,376,789 A | | 5/1945 | Leonard | |
| 3,611,034 A | * | 10/1971 | Astleford et al. | 317/40 R |
| 4,006,439 A | * | 2/1977 | Wien et al. | 335/15 |
| 4,138,602 A | * | 2/1979 | Eley | 200/67 R |
| 4,692,733 A | * | 9/1987 | Oakes | 337/158 |
| 4,727,229 A | * | 2/1988 | Hodkin | 200/144 B |

FOREIGN PATENT DOCUMENTS

| | | |
|---|---|---|
| DE | 3413219 | 10/1984 |
| DE | 3413219 A1 | 10/1984 |
| EP | 0653765 A1 | 5/1995 |
| EP | 0 653 765 | 5/1995 |
| EP | 0817346 | 1/1998 |
| FR | 2441938 | 6/1980 |
| GB | 270456 | 5/1927 |
| GB | 270456 | 6/1927 |
| JP | 07-264773 | * 10/1995 |

* cited by examiner

*Primary Examiner*—Lincoln Donovan
(74) *Attorney, Agent, or Firm*—Dykema Gossett PLLC

(57) ABSTRACT

The invention relates to a circuit breaker, which is in a fault situation arranged to disconnect an electrical apparatus, such as a distribution transformer, from an average voltage network or a high voltage network at each terminal. At least one link-spring mechanism is arranged at a shaft of the circuit breaker for holding contacts live in connected position and for pushing them apart to the extreme disconnected position when disconnected, while the shaft is brought over the dead spot of its turning. For an initial release, the shaft is at each phase provided with a lever arm, each lever arm at each phase being arranged to turn by a trip pin of a striker of a high voltage fuse the shaft of the circuit breaker and thus the moving contacts of all phases from said connected position over the dead spot of turning said shaft.

14 Claims, 2 Drawing Sheets

Figure 1:
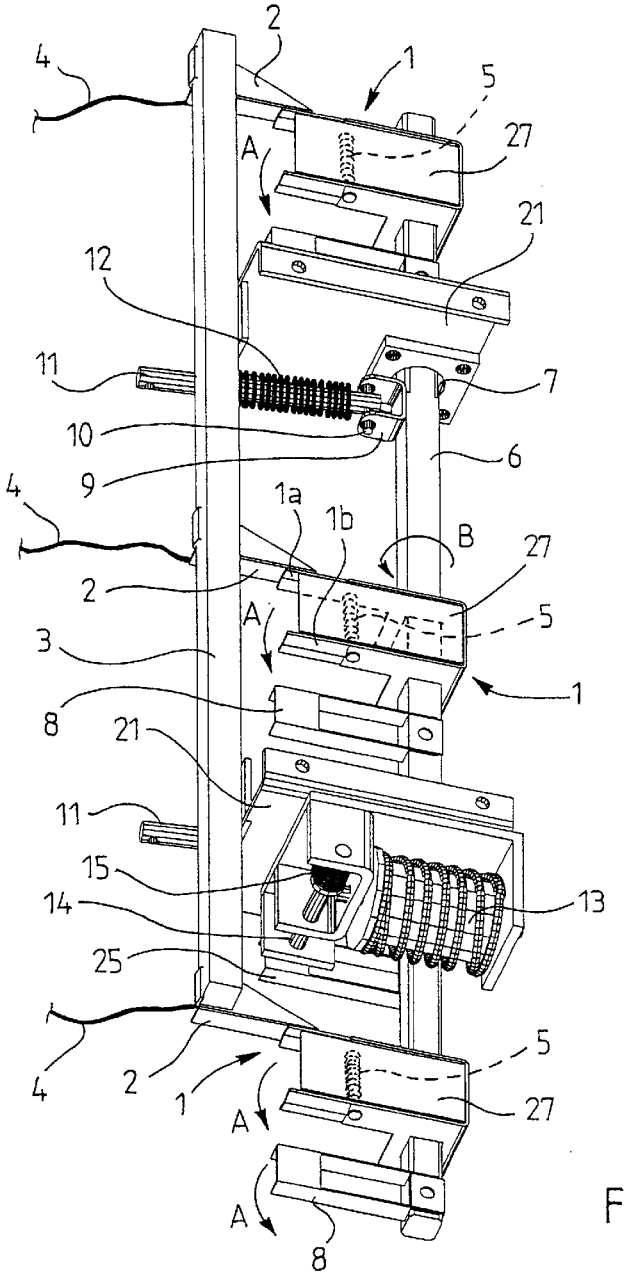

CIRCUIT BREAKER FOR DISCONNECTING AN ELECTRICAL APPARATUS FROM ELECTRICAL NETWORK

The invention relates to a circuit breaker, which is in a fault situation arranged to disconnect an electrical apparatus, such as a distribution transformer, from an average voltage network or a high voltage network at each terminal, and which comprises at each phase at least one fixed contact and a moving contact to be engaged with and disengaged from the fixed contact, each moving contact being fastened to a turning shaft of the circuit breaker and the circuit breaker being simultaneously electrically connected in series with a high voltage fuse situated at each phase.

Because of more and more stringent quality requirements of the electric power, the amount of interruptions in the use of a power line should be minimized and their duration shortened as much as possible. When a fault occurs in a distribution transformer, the length of interruption in the use of the line feeding electric current is shortened by immediate automatic disconnection of the transformer from the electrical network, because the line can be held live all the time during fault diagnosis and during preparations for changing the faulty transformer.

Oil-insulated distribution transformers have the special problem that, if a fault occurs in a winding of a transformer, the transformer oil in the transformer tank is heated and a gas mixture is generated in the tank. At its worst, the pressure in the tank rises so high that the tank tears and transformer oil leaks out on the ground causing environmental problems, risk of ground or other fire, or in the worst case, danger of explosion threatening human lives. Maintenance personnel is subjected to a particularly great danger when examining a faulty live transformer.

Distribution transformers and many special transformers are characterised in that their protective devices must operate without auxiliary supply voltages, possibly located outdoors, subjected to severe environmental conditions, for which reason the solutions known in the environment of high voltage transformers and implemented by means of protective relays and circuit breakers cannot be used economically in this connection.

A known solution for possible faults in a distribution transformer is to provide the primary side of the transformer with high voltage fuses. This solution has, however, the drawback that a two- or three-phase transformer remains live in a fault situation, because each phase is protected by its own fuse. After the fuse of one phase of a three-phase transformer has blown, current still flows therein. Additionally, when normal current limiting fuses are used, a coordination problem occurs, meaning a situation in which the current is not disconnected by fuse blow out, but remains flowing and causes a pressure rise inside the fuse until the fuse explodes. Standard IEC 282-1 (1985) does not require a breaking capacity of high voltage fuses at low overcurrents (generally below $3*I_n$). Further, for instance a cycle short circuit may cause such a low fault current that it cannot be indicated from the strength of the primary current and especially not protected by means of fuses, but a fault of this kind still causes a temperature and pressure rise in the transformer tank, and local oil heating causes gas generation.

French Patent 2 712 730 discloses a solution in which the primary circuit of a transformer at each phase comprises two high voltage fuses of different types in series with a three-phase circuit breaker. The circuit breaker opens according to the properties of the dielectric liquid of the transformer changing over a preset threshold value. This solution eliminates the coordination problem with fuse protection, but still leaves the transformer live at a reduced number of terminals in a fault situation, if the circuit breaker does not open. In addition, so much space is required for positioning he two fuses connected in series in connection with the transformer that the used standard transformer cannot be replaced as such by a solution of this kind without any alterations.

Among other close applications can be mentioned standard IEC 420 "High Voltage alternating current switch-fuse combinations", which defines the electrical and operative properties of fuse circuit breakers intended for AC use in the average voltage area.

As far as fuse circuit breakers using high voltage fuses as a trigger are concerned, it can be mentioned that, because the requirements for rated current are even dozens of times higher than the different requirements for the application area of the invention, said fuse circuit breakers shall always in practice be provided with complicated mechanisms released by a trip pin of a fuse striker, for increasing the power. For instance, the circuit breaker of a 160 kVA distribution transformer shall have a rated current of 15 A, while the lowest rated currents of circuit breakers are 630 A.

The object of the present invention is to eliminate the above drawbacks. This object is achieved by means of a circuit breaker, which is characterised in that the shaft of the circuit breaker is provided with at least one link-spring mechanism for holding the contacts live in connected position and for pushing them apart to the extreme disconnected position when disconnected, while the shaft is brought over the dead spot of its turning, and that the shaft is at each phase provided with a lever arm, each lever arm being arranged to turn by means of a trip pin of a striker of the high voltage fuse the shaft of the circuit breaker and thus the moving contacts of all phases from said connected position over said dead spot of turning said shaft.

Because the breaker mechanism according to the invention always breaks the voltage of all phases in a fault situation, the windings of the transformer remain entirely without voltage and current, though the fuse of one phase only has blown. The faulty transformer does not warm up then and no explosion sensitive gas mixture is generated, for which reason it is safe to examine the transformer and to change it into a new one.

The problem with the coordination of the fuse is eliminated, because upon the fuse blowing out, the circuit breaker opens and disconnects the current, and an explosion of the fuse is thus avoided. In the solution of the invention, only one fuse is needed for each feeding phase. If the fuse is integrated into a feedthrough insulator, the transformer can be provided with mechanical dimensions which make it changeable for a conventional transformer without protection.

The circuit breaker of the transformer according to the invention is further characterised in that the circuit breaker can be tuned to a working condition at the assembly of the transformer. The release limit of the arrangement can be dimensioned in such a way that the circuit breaker does not open in any switching or overload situation of the transformer, but only if the transformer becomes faulty. The mechanism can thus be retuned to the working condition at the maintenance and repair of the transformer, and no separate outside mechanisms are then needed for the control of the circuit breaker.

Figure 4:
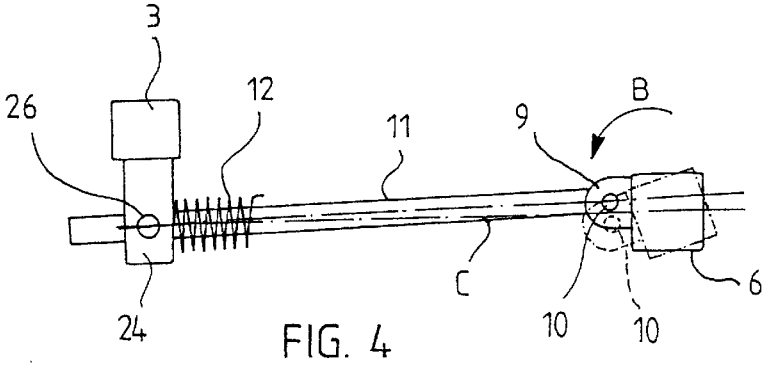
Figure 2:
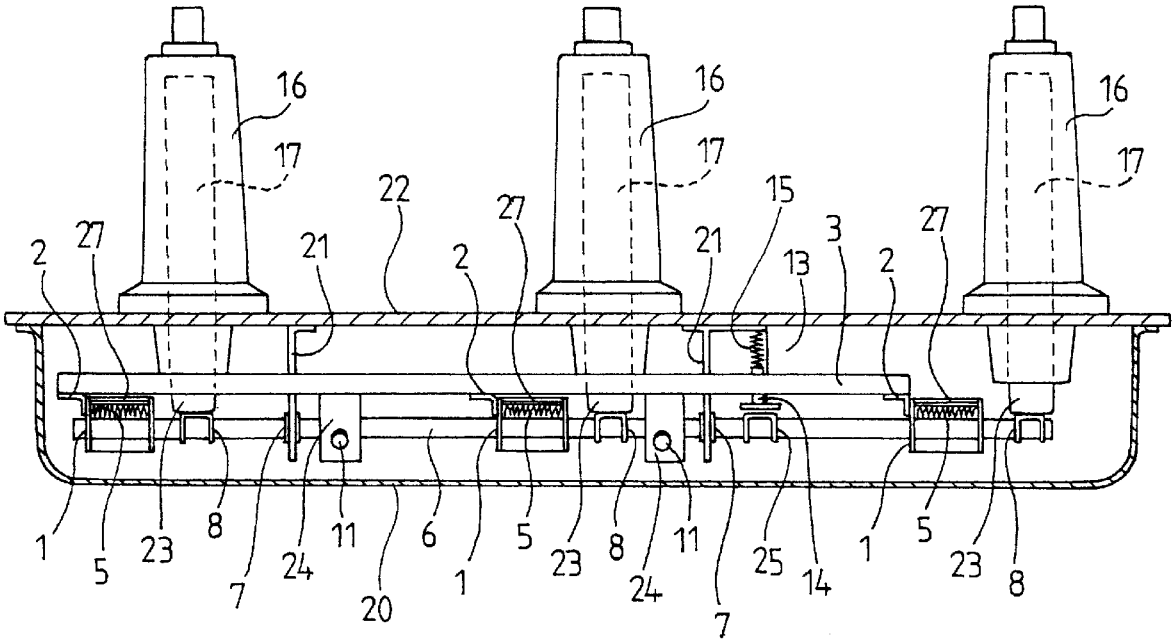
Figure 3:
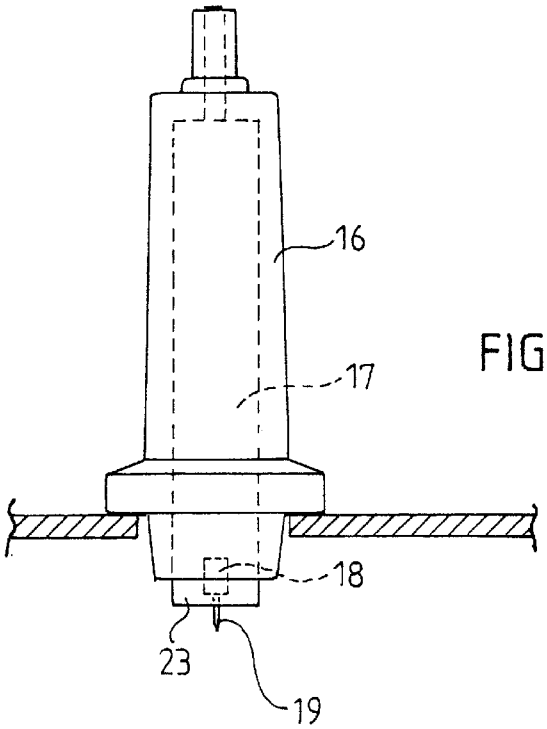

In the following, the invention will be described in greater detail with reference to the attached drawings, in which FIG. 1 shows a perspective view of a breaker mechanism, FIG. 2 shows a side view of the breaker mechanism of FIG. 1 positioned in a trough, to the cover of which are fastened high voltage fuses, FIG. 3 shows in greater detail a feedthrough insulator according to FIG. 2, into which a fuse is integrated, and FIG. 4 shows a general view of turning the shaft of the circuit breaker.

The basic components of a circuit breaker according to the invention are moving contacts 1 intended for each phase of a transformer and respective fixed contacts 2 cooperating with the moving contacts.

Ends 4 of a primary winding of the transformer are connected to the fixed contacts 2, which are fastened to a fastening rod 3 made of dielectric insulating material. On the other hand, the fastening rod 3 is fastened to frame parts 21 of the circuit breaker.

The U-shaped moving contacts 1 are mounted on a shaft 6, parallel with the fastening rod 3 and mounted in bearings on the frame parts 21 at points 7, to allow a revolution about its axis. The contacts 1 are arranged to act simultaneously by means of the shaft 6, and the contact force between the contacts 1 and 2 is each time given by a spring 5 tensioned between branches 1*a* and 1*b* of the moving contact 1. Further, because of the U-shape of the moving contacts 1, their contact force increases when the current increases, and consequently, the contact 1 endures a short circuit situation of the secondary side of the transformer and high currents caused by a fault in winding.

In accordance with FIGS. 2 and 3, the circuit breaker is immersed in a trough 20 filled with dielectric liquid, which trough guarantees the operation of the circuit breaker even though the casing (not shown in the drawings) surrounding the whole system has been leaking.

Each primary phase comprises a high voltage fuse 17 known from the use of fuse circuit breaker, which fuse is each time integrated into a feedthrough insulator 16 fastened to a cover 22 of the casing 20 and electrically connected in series with the circuit breaker.

When the breaker mechanism is in the closed position according to the FIGS. 1 and 2, an electrode 23 of the lower end of the fuse 17 is in contact with the shaft 6 of the moving contact 1 by means of a lever arm 8 each time arranged at the moving contact 1, while the moving contact 1 is connected to the fixed contact 2. At the lower end of the fuse 17, there is further a striker 18 tripping at the blow-out of the fuse. A substantial part of the striker 18 is a trip pin 19 bouncing out of the end of the fuse 17.

When the fuse 17 blows out, the movement of the trip pin 19 is transmitted to the shaft 6 by means of the lever arm 8.

The breaker mechanism comprises further at least one link-spring mechanism comprising a lug 9 fastened to the shaft 6, a tap 11 fastened to the lug with a cotter bolt 10, one end of the tap being fastened to the rod 3 by means of a support 24, and a pressure spring 12 mounted about the tap 11, which spring, in the closed position of the contacts 1 and 2, pushes slightly the breaker mechanism swung over the dead spot of turning the shaft 6 and prevents unintentional releases caused by impact or vibration. The dead spot of turning the shaft 6 signifies the line C shown in FIG. 4 (the line between one end of the tap 11, a fastening cotter 26 of the support 24, and the axis of the shaft 6), whereby the shaft 6 swings in the opposite direction when the cotter bolt 10 crosses said line C as a result of the operation of the trip pin 19. Accordingly, when the fuse 17 is operating, the operation of its trip pin 19 turns the shaft 6 and the moving contacts 1 of all phases from the closed position towards the open position over said dead spot.

After the shaft 6 has been brought over the dead spot of turning the shaft by the force of the trip pin 19, the force of the spring 12 of the link-spring mechanism continues turning the shaft 6 and thus the moving contacts 1 to the extreme open position at a sufficient speed so that the electric arc caused by the disconnected current breaks. This turning is shown in FIG. 1 by arrows A and B.

When the contacts 1 and 2 and also 1 and 23 open, two electric arcs in series increase the electric arc resistance and breaks the electric arc better than one contact. The breaking is based on the cooling phenomenon of the contact, caused by the oil used as dielectric liquid, and on a movement of the oil, which movement can be intensified by forming the moving contact 1 suitably or by providing it with a wing 27, for instance, which is arranged between the branches 1*a* and 1*b* of the contact 1.

Moreover, the breaker mechanism has been supplemented with a mechanical trip mechanism, comprising tight bellows 13 containing gas. When the pressure in the tank of the transformer or in the casing 20 of the breaker mechanism exceeds the preset threshold value, the bellows 13 sink down and trip a trip pin 14, which turns by the force of the spring 15 the shaft 6 and the contacts 1 of all phases from the closed position towards the open position over the dead spot of turning said shaft described above. Subsequently, the link-spring mechanism 9 to 12 opens the circuit breaker in the same way as at a release caused by a fuse. The operating point of over-pressure release depends slightly on the liquid temperature in the tank or in the casing 20, because the gas pressure inside the bellows 13 changes in accordance with the general formula $p*V/T=\text{constant}$.

Still another link-spring mechanism 9 to 12 is preferably fastened beside this arrangement, whereby these two mechanisms 9 to 12 guarantee a sufficient force for holding the connection and a sufficient force for pushing to the extreme open position in all situations.

In addition to the fuse and over-pressure protection, the system can also be supplemented with protections tripping on the basis of the temperature of the oil and the windings and on the basis of sinking liquid surface, which protections are not shown separately in the drawings. Temperature protections may comprise a temperature sensor arranged in connection with the circuit breaker, such as a bimetal means or a capillary provided with a trip pin. Correspondingly, the protection tripping by sinking liquid surface may comprise a float also provided with a trip pin. These pins are arranged to turn the shaft 6 of the circuit breaker by means of suitable lever arms over the dead spot of turning the shaft when the permitted temperature is exceeded and the permitted liquid-level value sinks in the same manner as in connection with the fuse and over-pressure protection described above.

Moreover, an electromechanical trigger can be arranged in connection with the circuit breaker for turning the shaft 6 of the circuit breaker by electric remote control, for instance, but otherwise in the above-described manner, and thus for disconnecting the contacts 1 and 2, when there is some other specific reason for this.

Auxiliary contact information on the state of the circuit breaker can additionally be detected by means of at least one auxiliary contact, for example to be transmitted by means of a remote control system to the operation supervisor.

The shaft 6 of the circuit breaker can also be brought through the walls of the structures surrounding the circuit breaker, whereby it is possible to arrange a mechanical outside display of position data and a retuning of the circuit breaker from outside the transformer.

It has to be noted further that the lever arm fastened to the shaft 6 and intended for the trigger means can also be integrated into the moving contact 1. Correspondingly, separate lever arms can be used for different triggers or some triggers may have a common lever arm.

The above specification of the invention is only intended to illustrate the invention. One skilled in the art may, however, implement its details within the scope of the attached claims in very many ways, in addition to those described above.

What is claimed is:

1. A circuit breaker having a plurality of terminals for a corresponding plurality of phases for a medium voltage or a high voltage network, comprising at each phase:

at least one fixed contact and at least one corresponding moving contact to be engaged and disengaged with each other;

a rotatable turning shaft for each phase having an axis of rotation, each corresponding moving contact being fastened to the turning shaft for rotation about the axis;

a lever arm coupled to the turning shaft for each phase;

a high voltage fuse at each phase, each fuse having an end including trip means thereat and further including a striker and a trip pin extending from the end of the fuse for engaging the lever arm, said shaft being rotatable between a first position wherein the lever arm engages the trip pin and a second extreme position wherein said lever arm is separated therefrom, said shaft having a dead spot therebetween adjacent to the first position, and said circuit breaker being electrically connected with the high voltage fuse at each corresponding phase;

at least one link-spring mechanism for holding the at least one fixed contact and the corresponding movable contact in electrical contact at the first position and for separating them to the extreme position, the turning shaft being positionable a the first position adjacent the dead spot by the link-spring mechanism, and the turning shaft being rotatable over the dead spot;

each lever arm engaging the trip means, said trip means being operable to release the lever arm for rotation from the first position over the dead spot to the second position with the turning shaft to thereby move the moving contact over the dead spot and out of engagement with the corresponding fixed contact;

a casing for receiving the circuit breaker therein; and a feedthrough insulator fastened to the casing for electrically connecting the circuit breaker therethrough.

2. The circuit breaker according to claim 1, wherein the electrical apparatus has a casing and the circuit breaker is located inside the casing.

3. The circuit breaker according to claim 1, wherein the circuit breaker is immersed in a dielectric liquid.

4. The circuit breaker according to claim 3, including a trough for receiving the circuit breaker therein, said trough having an open top for receiving the circuit breaker and the dielectric liquid therein and a cover for closing the top.

5. The circuit breaker according to claim 2, including a feedthrough insulation for receiving the high voltage fuse at least partially inside said feedthrough insulator, and which is fastened to the casing of the electrical apparatus.

6. The circuit breaker according to claim 2, wherein one end of the high voltage fuse comprises the fixed contact of the circuit breaker for each phase.

7. The circuit breaker according to claim 2, wherein the casing comprises a tank.

8. The circuit breaker according to claim 1, wherein the each lever arm is independent.

9. The circuit breaker according to claim 1, wherein the lever arm is coupled to the corresponding moving contact.

10. The circuit breaker, according to claim 1, further including a bellows, including a trip pin actuator, said bellows operable to release the actuator for engaging the lever in accordance with the selected change in ambient pressure.

11. The circuit breaker according to claim 1, comprising of bi-metal means, including a trip pin for turning the shaft in response to a change in ambient temperature.

12. The circuit breaker according to claim 1, including a mechanical trigger connected to the shaft for rotating the same in response to an electrical signal.

13. The circuit breaker according to claim 1, further including means separate from the trip means for operating the turning shaft.

14. A multiphase circuit breaker for disconnecting an electrical apparatus from a medium to high network at a terminal for each corresponding phase comprising:

a high voltage fuse including a blow out striker and a trip pin responsive to the blow out striker for each phase;

at least one fixed contact and a corresponding moving contact for each phase;

a shaft having an axis of rotation for carrying the movable contacts for rotation about said axis, said shaft having a dead spot adjacent to where the contacts are closed;

at least one spring mechanism coupled to the shaft for holding the respective contacts connected;

a lever arm for moving the shaft in response to the trip pin to turn the shaft over the dead spot to open the contacts.

* * * * *